US006581503B1

(12) United States Patent
Olin

(10) Patent No.: US 6,581,503 B1
(45) Date of Patent: Jun. 24, 2003

(54) METHOD OF MANUFACTURING A SOFT POINT BULLET

(75) Inventor: Brett Mathew Olin, Lewiston, ID (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 10/098,647

(22) Filed: Mar. 13, 2002

(51) Int. Cl.[7] ..... F42B 30/02
(52) U.S. Cl. ..... 86/55; 102/507; 102/510
(58) Field of Search ..... 102/501, 506–510, 102/514–518; 86/54, 55; 29/1.23

(56) References Cited

U.S. PATENT DOCUMENTS 1,134,797 A * 4/1915 Wood ..... 102/507
1,833,645 A * 11/1931 Hartz ..... 102/510
2,327,950 A * 8/1943 Whipple ..... 102/507
3,173,371 A * 3/1965 Manshel ..... 102/507
3,431,612 A * 3/1969 Darigo et al. ..... 102/514
4,387,492 A 6/1983 Inman
4,882,822 A * 11/1989 Burczynski ..... 86/54
4,947,755 A * 8/1990 Burczynski ..... 102/507
5,079,814 A 1/1992 Moore et al.
5,365,853 A * 11/1994 Petrovich et al. ..... 102/507

* cited by examiner

*Primary Examiner*—Harold J. Tudor
(74) *Attorney, Agent, or Firm*—Brinks Hofer Gilson & Lione

(57) ABSTRACT

A method of manufacturing a soft point bullet and the bullet resulting there from. The method comprises forming a bullet core of a first material plated with a second material; providing a cavity in one end of the plated core of preferably polygonal shape and positioning a shaped blank of plating material into the cavity; and forming the core into the final bullet size and shape by extruding the core into the cavity to form the bullet nose and encapsulate the shaped blank within the bullet.

17 Claims, 1 Drawing Sheet

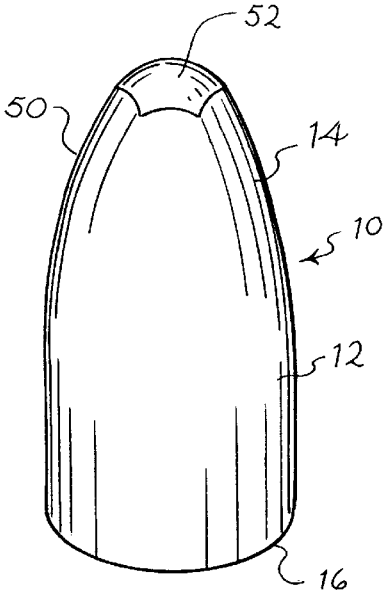
Fig. 1
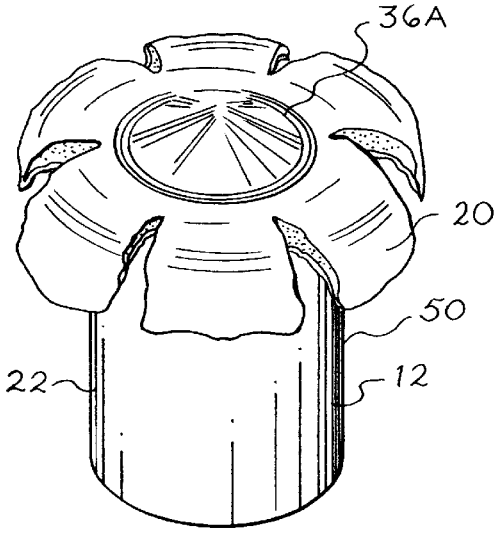
Fig. 2
Fig. 3A
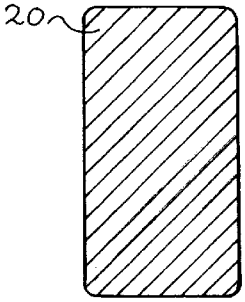
Fig. 3B
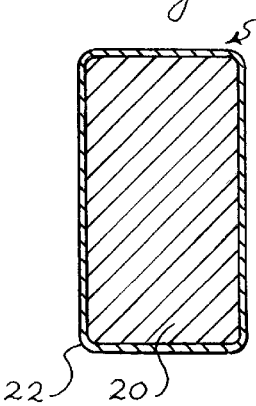
Fig. 3C
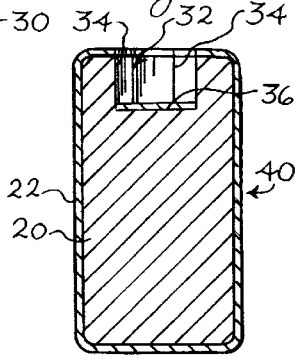
Fig. 3D
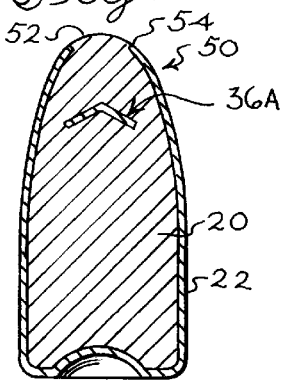
Fig. 4
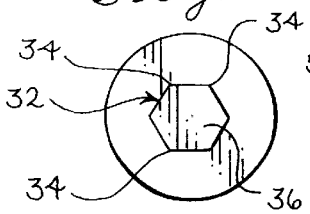
Fig. 5
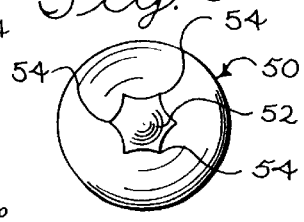

METHOD OF MANUFACTURING A SOFT POINT BULLET

BACKGROUND AND SUMMARY OF THE INVENTION

This invention relates to a method of manufacturing a soft point or soft nose bullet and the bullet resulting from the method.

Jacketed or plated soft point bullets are generally well known. In such bullets a core of soft metal such as lead or a lead alloy is plated with a jacket of copper or copper alloy. The copper or a copper alloy provides a degree of lubrication for the bullet as it passes through the rifling of a gun barrel. This minimizes damage which would otherwise occur to the barrel with a solid lead bullet. The jacket further maintains the integrity of the bullet intact as the soft point expands on impact.

As discussed in U.S. Pat. No. 4,387,492 for a "Plated Jacket Soft Point Bullet", it is common to produce soft point bullets by making a cup-shaped jacket of copper or the like, and by inserting a core from a base metal such as lead. Nose weakening features may be added to the bullet nose in subsequent operations to produce a soft point bullet. This prior technique resulted in several problems including the potential for separation of the core from the jacketing material.

Conventional bullet fabrication techniques further produce inconsistencies in shape and weight that can cause inaccurate flight of the bullet. Prior methods required trimming and matching in an effort to mate the right weight and size core with the right weight and size outer jacket. The nose weakening features to induce expansion of the bullet typically are sliced or drawn into the outer jacket of the bullet. These operations usually required additional machining and could introduce eccentricity in a bullet that could detrimentally affect its use.

The method disclosed in the above noted U.S. Pat. No. 4,387,492 improved upon conventional bullet-making techniques by electroplating the material such as copper to the lead core which had been shaped to the proximate size and shape of the bullet. The electroplated material and part of the soft core is then sheared from the forward end of the core and the bullet is reshaped into the final shape. This improved forming operation produces an unplated forward portion of the bullet which would expand upon impact. The use of such shearing techniques to expose the softer core of the bullet tip, however, could cause distortion and thickening of the outer jacket of the bullet and affect the bullet performance. U.S. Pat. No. 5,079,814 also discloses a technique for making a hollow point bullet by electroplating the jacket to the core.

An object of this invention is to provide a method of manufacturing a soft point bullet and an improved bullet resulting from such method which overcomes many of the disadvantages of prior art methods and devices.

A further object of this invention is to provide an improved method for manufacturing a soft point bullet which minimizes the distortion and thickening of the bullet jacket and lessens the inaccuracies common to prior operations. An object of the invention also is to simplify bullet fabrication by reducing or eliminating the need for jacket trimming and weight matching to produce the final bullet.

An additional object of this invention is to provide a method of making a soft point bullet that does not materially change the weight of the bullet during manufacture and results in little or no scrap material.

A still further object is to provide a method of manufacturing a soft point bullet and the bullet itself which allows for the regulation of the expansion of the bullet when the bullet impacts a target.

Another object of this invention is to provide a method of making soft point bullets which is readily adaptable to make bullets having a small caliber.

In accordance with the present invention, the method of manufacturing a soft point bullet includes the step of forming a core of a soft material such as lead or a lead alloy, e.g., lead and antimony, into a selected shape, preferably a generally right cylinder. The core of soft material is then plated with a plating material such as copper or copper alloy to form a plated core of a selected geometric shape. The plated core is then fed into a forming machine and one end of the plated core is subjected to an operation, such as punching, to form a cavity in the one end. In the preferred embodiment the cavity is polygonal in shape and has a generally flat face. A six-sided polygonal cavity is preferred, but a cavity with three to ten sides can be used for different ballistic requirements for the bullets. The length or depth of the cavity can be selected to suit the size of the bullet and produce the desired operating characteristics. The side walls of the cavity can be straight or tapered inwardly to slightly narrow the cavity in a direction away from the one end of the bullet. Other tool or die shapes also can be used to produce the desired cavity having a plurality of spaced surfaces. The method in accordance with this invention provides multiple notches or cuts in the plated material spaced around the periphery of the cavity and defines multiple fracture points spaced generally uniformly around the nose of the bullet.

This forming operation also drives a pointed or polygonal blank of the plating material into the interior of the soft core at the lower portion of the cavity. The position of the blank is determined by the depth of the cavity, and can be adjusted by changing the penetration of the tool used to create the cavity.

The resulting blanked core formed by the above process is further formed under pressure, such as by swaging, to extrude the soft core material around the pointed or polygonal material blank positioned within the core. This pressure also extrudes the soft material of the core into the cavity and shapes the plating material to form the blanked core into a soft point bullet having a conical tip or ogive on the one end. The bullet is then subjected to finishing operations such as tumbling and polishing to form the final soft point bullet.

The soft point bullet manufactured in accordance with this invention includes a soft material core made from, for example, a metal such as lead or a lead alloy, that is plated with a jacket of a harder material, such as copper or copper alloy. Multiple fracture points are formed into the plated jacket at the nose of the bullet. These fracture points are generally spaced uniformly around the front end of the bullet and allow the bullet to expand or mushroom upon impact with the target. The polygonal shaped blank of plating material retained within the core toward the nose becomes generally dome-shaped during manufacture. The extent of the reshaping of the blank into a domed shape depends upon the diameter of the bullet. The blank inside the core operates as an expansion regulation for the bullet. Tooling and process adjustments can be made to vary the size, shape and depth of the blank within the core and to allow for the alteration of the expansion characteristics of the bullet to meet specific performance requirements.

BRIEF DESCRIPTION OF THE DRAWINGS

The manner in which the foregoing and other objects and advantages of the present invention can be accomplished will become more apparent from the following description of an exemplary embodiment and from the appended claims, considered in conjunction with the drawings wherein:

FIG. 1 is the perspective view of a soft point bullet constructed in accordance with the present invention;

FIG. 2 is a perspective view of a bullet of this invention shown as expanded after impact;

FIGS. 3A–D are cross-sectional views illustrating progressive steps of the manufacture of a bullet in accordance with this invention;

FIG. 4 is a top view of the blanked core for the bullet as illustrated in FIG. 3C; and FIG. 5 is a top view of the final bullet formed in accordance with the invention, as shown in FIG. 3D.

DETAILED DESCRIPTION OF THE INVENTION

Referring to FIG. 1 of the drawings, a bullet 10 manufactured in accordance with this invention has a generally cylindrical main body 12. A front end of a bullet forms a nose portion 14. The bullet also includes a generally flat second or rear end 16. The core of the bullet is made from a deformable metal such as lead or a lead alloy which is electroplated with a jacketing material such as copper or copper alloy.

The initial phase of the method of manufacturing the soft point bullet includes the formation of a slug 20 of soft metal such as lead alloy formed into a selected geometric shape. This slug 20 can be made, for example, from lead and antimony, and is preferably formed into a generally right cylinder, as illustrated in FIG. 3A. The slug 20 is then plated with a plating metal 22 such as copper or copper alloy to form a plated core 30 of generally cylindrical shape. FIG. 3B illustrates the resulting plated core 30 comprising the soft metal slug 20 and the outer plating material 22.

The plated core 30 in accordance with this invention is then fed into a forming machine or the like and one end is subjected to an operation such as punching. In the preferred embodiment, the punch is polygonal in shape and has a generally flat face. As shown in FIGS. 3C and 4, a six-sided polygonal punch is preferred, although other tool shapes can be used to produced the desired results. A preferred range is a shape having from 3 to 10 sides or surfaces. The punching of the plated core 30 with the polygonal punch forms a cavity 32 and multiple cuts or notches 34 spaced uniformly around the periphery of the punched cavity 32. This punching operation further drives a polygonal metal blank 36 of the plating material into the interior of the soft metal core 20. The shape of the blank 36 corresponds to the shape of the cavity 32, as shown in FIG. 4. This operation results in the formation of a blanked plated core 40, as illustrated in FIG. 3C.

The blanked core 40 is further formed under pressure, such as by swaging, to extrude the metal forming the soft core 20 and the plating material 22 into the final bullet shape. This forming operation extrudes the soft metal core 20 into the cavity 32 to form the conical nose or ogive and to encapsulate the blank 36. The metal blank 36 may be reshaped by the pressure on the core 20 to a generally conical or dome-shape blank 36A having a v-shaped cross-section, as shown in FIG. 3D. The final shape of the blank 36A depends on the diameter of the bullet. The blanked core 40 is thereby shaped into a soft point bullet 50, as illustrated in FIGS. 3D and 5. The resulting soft point bullet 50 has a conical soft metal tip 52 formed from the punched front end of the blanked core 40. The multiple cuts or notches 34 in the plating material 22 are compressed inwardly and form multiple fracture points 54 in the bullet nose.

The soft point bullet 50 manufactured in accordance with this invention thereby includes a soft metal core 20 made from lead or a lead alloy plated with a jacket 22 of metal such as copper or copper alloy. Fracture points 54 around the nose 52 of the bullet allow the bullet to expand or mushroom upon impact with the target, as shown in FIG. 2. Moreover, the polygonal shaped blank 36A of plating material which is captured in the bullet nose 52 within the core 20 operates as an expansion regulation for the bullet, to control the expansion upon impact with the target. The soft nose 52 of the bullet generally will expand or mushroom down to a location near the position of the blank 36A inside the bullet, such as illustrated in FIG. 2. As a result, the nose portion of the bullet 50 will mushroom uniformly and predictably without substantial fragmentation or over-expansion of the soft point of the bullet. The depth and shape of the blank 36A and the number and location of the fracture points 54 can be adjusted for different bullet diameters and different performance characteristics. The bullet in accordance with this invention is manufactured in a manner that produces virtually no scrap that must be handled or discarded.

Although the foregoing description of an exemplary embodiment of the invention has been set forth above, it is recognized that variations and modifications of the method of producing the soft point bullet, and the resulting soft point bullet, are possible without departing from the spirit and scope of this invention as claimed.

I claim:

1. The method of manufacturing a soft point bullet comprising the steps of:

forming a bullet core of a selected geometric shape from a deformable first material;

plating the deformable core with a second material to form a plated core;

forming a cavity in one end of the plated core having a selected shape and having a blank of plating metal positioned within the cavity to create a blanked core; and forming the blanked core in a selected bullet size and shape having a soft point nose formed by extruding the deformable first material into the cavity and encapsulating the blank of plating material within the deformable core.

2. The method of claim 1 wherein the bullet core is in the shape of substantially a right cylinder.

3. The method of claim 1 wherein the encapsulated blank is positioned proximate the nose of the bullet.

4. The method of claim 1 wherein a shaped cavity is formed in one end of the plated core to position a shaped blank of plating material into the cavity and provide multiple fracture points in the plating material on said one end of the plated core.

5. The method of claim 4 wherein the shaped cavity has a polygonal shape with from 3 to 10 sides and provides a corresponding number of fracture points.

6. The method of claim 5 wherein the polygonal shaped cavity has six sides and provide six fracture points.

7. The method of claim 4 wherein the forming of the blanked core into said bullet shape deforms the encapsulated blank into a generally conical shape and positions the fracture points generally uniformly around the nose of the bullet.

8. The method of claim 4 wherein the cavity is formed with a polygonal tool having a generally flat end impacting the plated core.

9. The method of claim 1 wherein the first material is selected from the group consisting of lead or lead alloy and the second material is selected from the group consisting of copper or copper alloy.

10. The method of claim 1 including the steps of regulating the expansion characteristics of the soft point bullet by encapsulating the blank at a selected position within the core.

11. The method of claim 10 including the step of varying the selected position of the blank within the core to vary the expansion characteristics of the bullet.

12. The method of claim 1 wherein the cavity is formed with straight sidewalls.

13. The method of claim 1 wherein the cavity is formed with sidewalls that taper inwardly toward the interior of the cavity.

14. The method of manufacturing a soft point bullet comprising the steps of:

forming a deformable first metal into a bullet core having a generally right cylindrical shape;

plating the deformable core with a second metal to form a plated core;

inserting a tool into one end of the plated core to a selected penetration to form a polygonal shaped cavity in said one end and form a blanked core having a polygonal shaped blank of plating metal at a selected location within the cavity and further defining multiple fracture points in the adjacent second metal; and forming the blanked core into a bullet shape by extruding the deformable first metal into the cavity to encapsulate the plating metal blank and form the first and second metal into a generally conical shaped nose including said encapsulated blank and having said multiple fracture points spaced generally uniformly around said nose.

15. The method of claim 14 wherein the first metal is selected from the group consisting of lead or lead alloy and the second metal is selected from the group consisting of copper or copper alloy.

16. The method of claim 14 wherein the forming of the blanked core into a bullet shape deforms the blank of plating material within the core to a generally conical shape.

17. The method of claim 14 including the step of varying the selected penetration of said tool and position of the blank within the core to vary the expansion characteristics of the bullet.

* * * * *